US005419645A

United States Patent [19]

Russo

[11] Patent Number: 5,419,645

[45] Date of Patent: May 30, 1995

[54] ENVELOPE CASSETTE TRAY

[75] Inventor: Christopher M. Russo, Milford, Conn.

[73] Assignee: Pitney Bowes Inc., Stamford, Conn.

[21] Appl. No.: 787,350

[22] Filed: Nov. 4, 1991

[51] Int. Cl.[6] ..... B41J 13/12

[52] U.S. Cl. ..... 400/624; 271/148; 271/160

[58] Field of Search ..... 271/2, 126, 127, 145, 271/147, 148, 160, 162, 164, 170, 171; 400/624, 625, 626, 629

[56] References Cited

U.S. PATENT DOCUMENTS

| | | | |
|---|---|---|---|
| 3,446,500 | 5/1969 | Meier | 271/148 |
| 3,567,216 | 3/1971 | Zeller | 271/148 |
| 3,919,972 | 11/1975 | Komori et al. | 271/118 |
| 4,032,137 | 6/1977 | Katayama et al. | 271/164 |
| 4,307,878 | 12/1981 | Kono | 271/22 |
| 4,343,461 | 8/1982 | Tomimori et al. | 271/22 |
| 4,372,547 | 2/1983 | Yanagawa et al. | 271/10 |
| 4,484,734 | 11/1984 | Tsudaka et al. | 271/9 |
| 4,711,443 | 12/1987 | Fujiwara et al. | 271/148 X |
| 4,744,472 | 5/1988 | Pfistea | 271/148 X |
| 4,780,740 | 10/1988 | Fukae | 355/3 SH |
| 4,861,017 | 8/1989 | Yamamoto et al. | 271/258 |
| 4,915,370 | 4/1990 | Himeji et al. | 271/162 |
| 5,005,820 | 4/1991 | Leemhuis | 271/127 |
| 5,013,025 | 5/1991 | Arai et al. | 271/164 |
| 5,069,434 | 12/1991 | Sellers | 271/145 X |

FOREIGN PATENT DOCUMENTS

| | | | |
|---|---|---|---|
| 0190126 | 10/1984 | Japan | 271/160 |
| 0051222 | 3/1991 | Japan | 271/126 |

OTHER PUBLICATIONS

U.S. patent application No. 07/792,112; to: Czernik et al. filed: Nov. 14, 1991.

U.S. patent application No. 07/752,920; to: Murko et al. filed Jul. 29, 1991–continuation of: no: 07/492,035.

*Primary Examiner*—Chris A. Bennett

*Attorney, Agent, or Firm*—Robert H. Whisker; Melvin J. Scolnick

[57] ABSTRACT

A cassette for feeding envelopes to a printer. The cassette includes an elevator mechanism for continuously raising a stack of envelopes to maintain contact with a feed mechanism in the printer as envelopes are fed from the stack. The elevator pivots vertically around its back edge and is hinged to rotate orthogonally to the direction in which the envelopes are fed. The orthogonal rotation allows the envelope to remain horizontal even through the stack of flaps is thicker along its flap edge.

8 Claims, 3 Drawing Sheets

ENVELOPE CASSETTE TRAY

SUBJECT OF THE INVENTION

The subject invention relates to printing systems, and more particularly it relates to a cassette for use with a printing system for input of envelopes to be printed. (As used herein the terms "printing system" and "printer" mean both printers per se, which convert input signals to printed indicia, copiers, which reproduce previously printed indicia, and like systems for producing printed indicia, and with which cassettes for input of discreet items are used.)

Cassettes for use with laser printers and the like are well known. Such cassettes provide a simple and convenient manner by which an operator may change the type of item input to a printer. For example, simply by changing cassettes an operator may change input from $8\frac{1}{2}\times 11$ cut sheets to legal size cut sheets, or to A size cut sheets. It is also well known to use laser printers or the like to print addresses on envelopes. Accordingly, many printers are provided with a cassette for input of envelopes.

Accordingly, it is an object of the subject invention to provide an envelope cassette for input of envelopes which will provide a more reliable envelope feeding operation.

BRIEF SUMMARY OF THE INVENTION

The above objects are achieved, and the disadvantages of the prior art are overcome in accordance with the subject invention by means of a cassette which includes a tray and an apparatus (herein sometimes referred to as an elevator) mounted within the tray for supporting a stack of envelopes for input to a printer. The printer includes a mechanism, such as a take-up roller, for successively feeding envelopes from the stack. The elevator is mounted within a tray to form the cassette and is selectively engageable and disengageable from the printer. The elevator further includes a platform for supporting the stack with the flap and bottom edges of the envelopes oriented in the direction in which the envelopes are fed and springs or similar elevating apparatus for raising the platform as the envelopes are successively fed from the stack so that the top envelope of the stack maintains contact with the take-up roller. The cassette also includes a hinge or other such mechanism which cooperates with the springs to support the platform, and which provides the platform with the capability to rotate orthogonally about the centerline of its width as directed to the feed direction. As will be apparent to those skilled in the art envelopes are thicker along the flap edge since the (closed) flap adds an extra ply to the thickness of the envelope. The rotational capability provided to the platform allows the platform to conform to this increased thickness and allows the top envelope on the stack to remain substantially horizontal and parallel to the take-up roller, thereby improving the feed characteristics of the cassette.

Thus can be seen that the disadvantages of the prior art are overcome, and the above objects achieved, by the subject invention. Other objects and advantages of the subject invention will become apparent to those skilled in the art from consideration of the detailed description set forth below and of the attached drawings.

DETAILED DESCRIPTION OF PREFERRED EMBODIMENTS OF THE SUBJECT INVENTION

Figure 1:
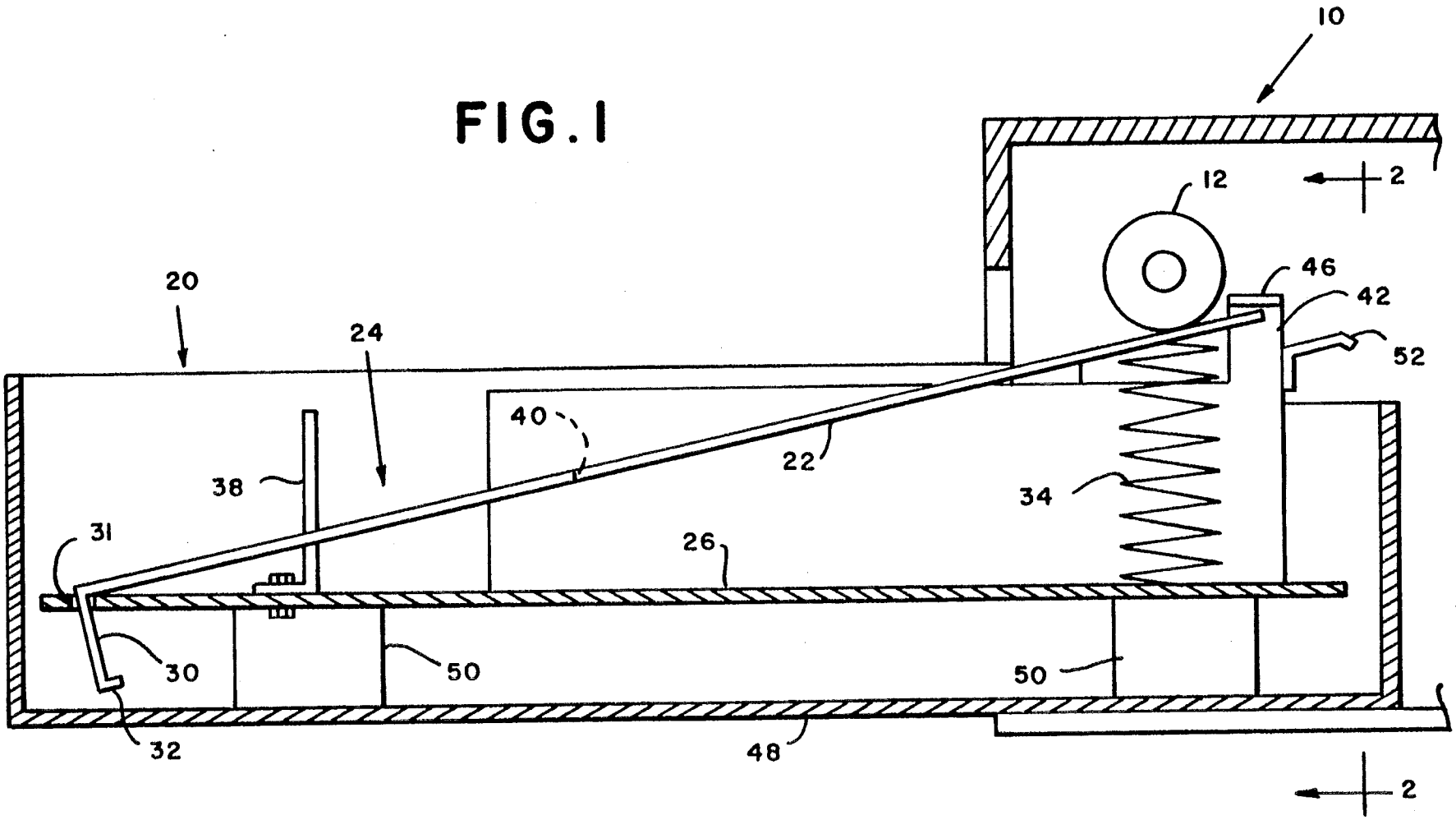
FIG. 1 is a cross-sectional view, taken along lines I—I of FIG. 2, of a cassette in accordance with the subject invention shown engaged with a conventional printing apparatus.
Figure 2:
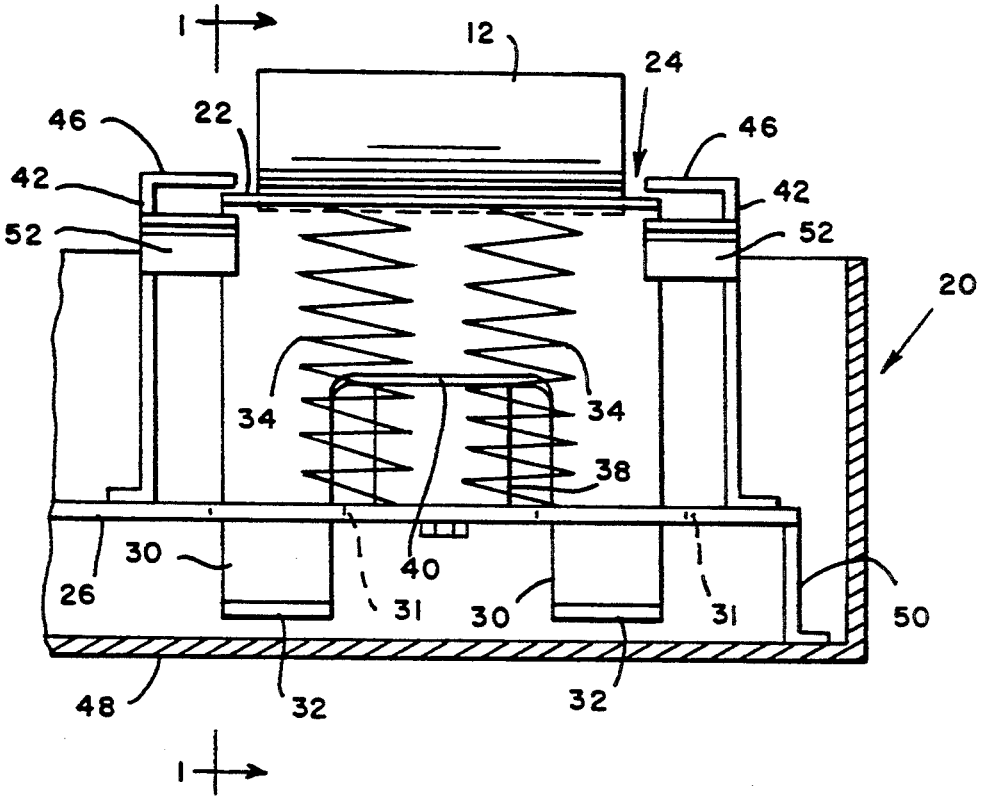
FIG. 2 is a cross-sectional view of the cassette of FIG. 1 taken along lines II—II in FIG. 1.

A conventional printer 10 (shown in FIG. 1) includes a conventional take-up roller 12. Cassette 20 is shown in FIG. 1 in engagement with printer 10 so that, as cassette 20 as shown empty in FIG. 1, take-up roller 12 bears upon platform 22 of elevator assembly 24.

Elevator assembly 24 also includes a base 26 to which platform 22 is attached by extended members 30 which are attached to the rear edge of platform 22 and project through openings 31 in base 26, and which are provided with tabs 32 to prevent members 30 from being withdrawn through openings 31. Preferably members 30 are formed by bending extended rear portions of platforms 22 through an angle of approximately 90 degrees. Platform 22 is also supported at its forward end by a pair of springs 34 which apply an upwards force on the forward end of platform 22, which is free to pivot about its rear edge in the plane of FIG. 1 so that platform 22, when no envelopes are present, bears against roller 12.

Cassette 20 also includes a stop assembly 38 which can be adjusted in slot 40 provided in platform 22 to accommodate envelopes of various lengths.

Figure 3:
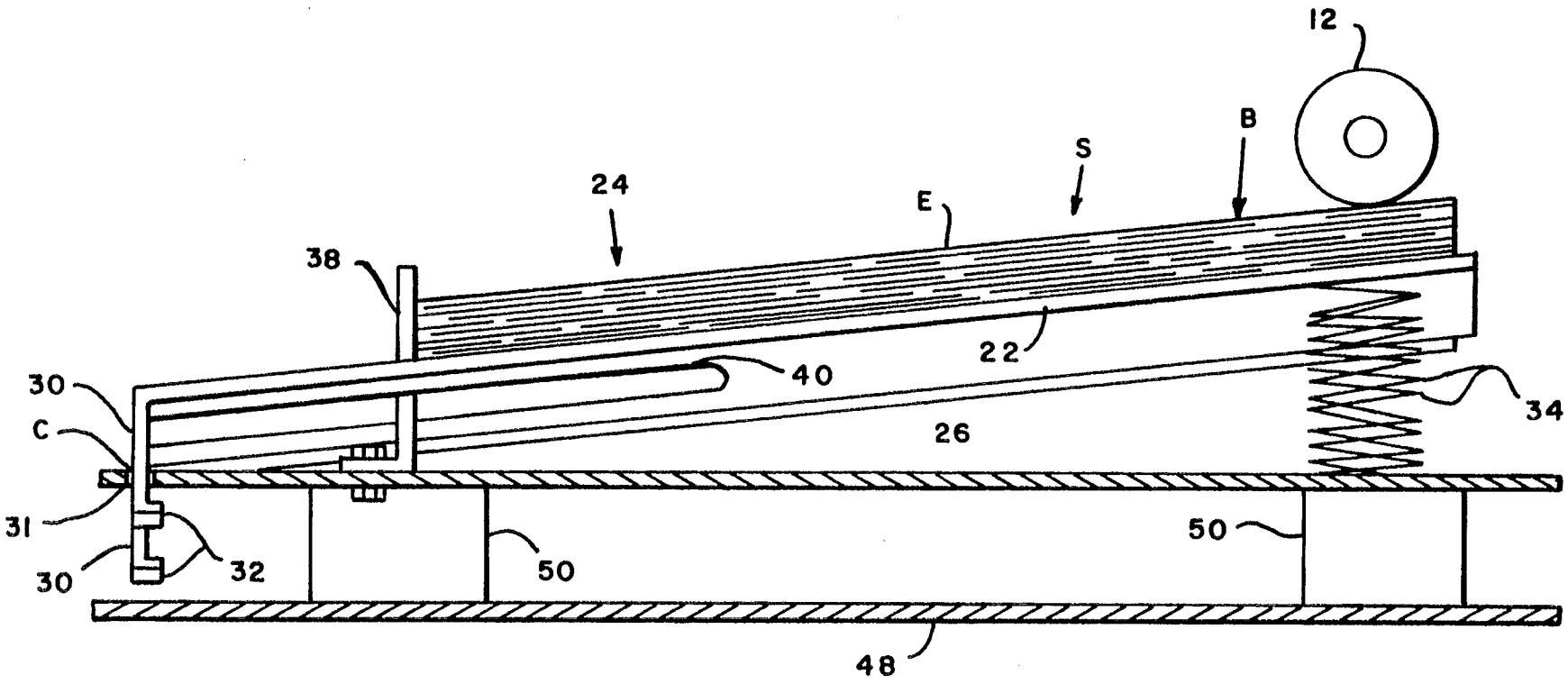
FIG. 3 is a cross-sectional view, partially broken away, of a cassette in accordance with the subject invention and shown with a stack of envelopes.

Cassette 20 is also preferably provided with guides 42 for providing lateral guidance to envelopes as they are fed to printer 10, and guides 42 are preferably provided with tabs 46 to hold down a stack of envelopes (as is best seen in FIG. 3).

Elevator assembly 24, guides 42, and adjustable stop 38 are mounted in housing 48 by mounts 50 in a conventional manner.

Cassette 20 is preferably also provided with guides 52 to provide further support to an envelope as it is fed to printer 10 in a conventional manner.

Figure 4:
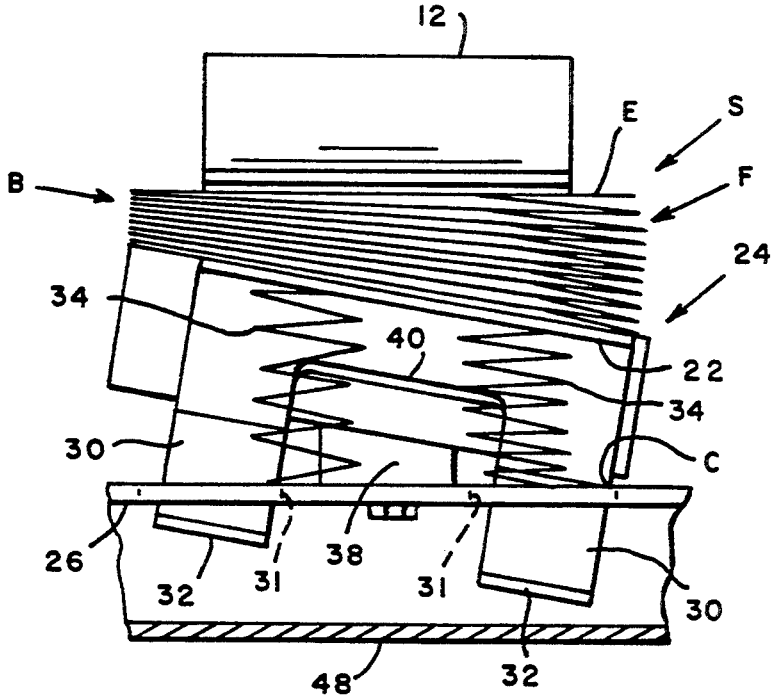
FIG. 4 is a front plan view, partially broken away, of the cassette of FIG. 3.

Turning now to FIGS. 3 and 4 a stack of envelopes S is shown supported by platform 22 and stop assembly 38, which has been adjusted so that a forward portion of stack S is under roller 12 and the top envelope E is held in contact with take-up roller 12 by springs 34. Stack S is oriented so that the bottom edges B and flap edges F of the envelopes in stack S are aligned in the direction in which the envelopes are fed to printer 10.

As can best be seen in FIG. 4, because of the extra ply of the flaps of the envelopes in stack S, in the closed position, stack S is thicker adjacent to flap edges F and tapers towards bottom edges B. In accordance with a preferred embodiment of the subject invention this is accommodated, as best shown in FIG. 4, by the extended length of members 30 which allows the side of platform 22 adjacent to bottom edges B to rise farther as platform 22 pivots about rear corner C which is adjacent to flap edges F. Thus platform 22 conforms to the taper of stack S and the top envelope E of stack S is substantially horizontal and parallel to take-up roller 12.

As can readily be seen if platform 22 did not conform to the taper of stack S take-up roller 12 would not bear uniformly on stack S, but would apply little or no force to envelope E adjacent to bottom edges B, which would reduce the reliability of the feed operation for envelopes from such a cassette.

As can be seen in FIG. 4 platform 22 is symmetrical around its centerline and is free to rotate in either a clockwise or counter-clockwise direction to conform to stacks of envelopes with the corresponding taper.

The above detailed description has been provided by way of illustration only and numerous embodiments of the subject inventions would be apparent to those skilled in the art from consideration of the above description and the attached drawings. Particularly other mechanisms to allow the platform to rotate orthogonally to the feed direction, such as universal joints, ball and socket joints, and other means of connection which would allow the necessary two degrees of freedom are within the contemplation of the subject invention. Thus limitations on the subject invention are to be found only in the claims set forth below.

What is claimed is:

1. A cassette for selective engagement and disengagement with a printer, said printer including a mechanism for successively feeding envelopes from said cassette, comprising:

(a) a tray;

(b) elevator means mounted within said tray for supporting a stack of said envelopes for input to said printer and for maintaining the top envelope of said stack in contact with said mechanism as said envelopes are successively fed from said stack, said elevator means further comprising:

(b)(1) a platform for supporting said stack with the flap and bottom edges of said envelopes oriented in the direction in which said envelopes are fed;

(b)(2) elevating means for raising said platform as said envelopes are successively ted so that the top envelope of said stack remaintains contact with said mechanism;

(b)(3) rotational means, cooperative with said elevating means for supporting said platform, for providing said platform with a capability to rotate orthogonally to said direction, whereby said platform conforms to the increased thickness of said stack along the flap edges of said envelopes, and the top envelope of said stack is maintained in an orientation parallel to said mechanism;

(b)(4) said rotational means further comprising a pair of extended members fixed to the rear of said platform and projecting downwards through a pair of corresponding holes provided in said base; and the length of said extended members and the dimensions of said holes being selected so that said platform is free to rotate to conform to the taper of said stack of envelopes without said extended members becoming disengaged from said base; and (c) a base, said base supporting said platform and being mounted in said tray so that a vertical clearance exists between said tray and said base.

2. A cassette as described in claim 1 wherein said extended members include tabs to prevent said platform from becoming disengaged from said base.

3. A cassette as described in claim 1 wherein said rotational means comprises an extended member, said extended member being formed by bending a rear portion of said platform through an angle of approximately 90 degrees projecting downwards through a corresponding slot provided in said base, the length of said extended member and the dimensions of said slot being selected so that said platform is free to rotate to conform to the taper of said stack of envelopes without said extended member becoming disengaged from said base.

4. A cassette as described in claim 1 wherein said elevating means are disposed so that said platform is free to rotate both in a clockwise and a counter clockwise direction about its centerline to conform to stacks of envelopes which taper correspondingly.

5. A printing system comprising a printer and a cassette, said printer including a mechanism for selectively feeding envelopes from said cassette, said cassette further comprising:

(a) a tray;

(b) elevator means mounted within said tray for supporting a stack of said envelopes for input to said printer and for maintaining the top envelope of said stack in contact with said mechanism as said envelopes are successively fed from said stack, said elevator means further comprising:

(b)(1) a platform for supporting said stack with the flap and bottom edges of said envelopes oriented in the direction in which said envelopes are fed; said platform is supported on a base, said base being mounted in said tray so that a vertical clearance exists between said tray and said base;

(b)(2) elevating means for raising said platform as said envelopes are successively fed so that the top envelope of said stack remaintains contact with said mechanism;

(b)(3) rotational means, cooperative with said elevating means for supporting said platform, for providing said platform with a capability to rotate orthogonally to said direction, whereby said platform conforms to the increased thickness of said stack along the flap edges of said envelopes, and the top envelope of said stack is maintained in an orientation parallel to said mechanism;

(b)(4) said rotational means further comprising a pair of extended members fixed to the rear of said platform and projecting downwards through a pair of corresponding holes provided in said base: and the length of said extended members and the dimensions of said holes being selected so that said platform is free to rotate to conform to the taper of said stack of envelopes without said extended members becoming disengaged from said base.

6. A cassette as described in claim 5 wherein said extended members include tabs to prevent said platform from becoming disengaged from said base.

7. A cassette as described in claim 6 wherein said rotational means comprises an extended member, said extended member being formed by bending a rear portion of said platform through an angle of approximately 90 degrees projecting downwards through a corresponding slot provided in said base, the length of said extended member and the dimensions of said slot being selected so that said platform is free to rotate to conform to the taper of said stack of envelopes without said extended member becoming disengaged from said base.

8. A cassette as described in claim 5 wherein said elevating means are disposed so that said platform is free to rotate both in a clockwise and a counter clockwise direction about its centerline to conform to stacks of envelopes which taper correspondingly.

* * * * *